US007161564B2

(12) United States Patent
Lee et al.

(10) Patent No.: US 7,161,564 B2
(45) Date of Patent: Jan. 9, 2007

(54) APPARATUS AND METHOD FOR DRIVING A PLASMA DISPLAY PANEL

(75) Inventors: Jun-Young Lee, Cheonan (KR); Dae-Gyu Kim, Cheonan (KR)

(73) Assignee: Samsung SDI Co., Ltd., Suwon (KR)

( * ) Notice: Subject to any disclaimer, the term of this patent is extended or adjusted under 35 U.S.C. 154(b) by 381 days.

(21) Appl. No.: 10/393,022

(22) Filed: Mar. 21, 2003

(65) Prior Publication Data

US 2003/0193454 A1 Oct. 16, 2003

(30) Foreign Application Priority Data

Apr. 15, 2002 (KR) ..... 10-2002-0020398

(51) Int. Cl.
*G09G 3/28* (2006.01)
*G09G 5/00* (2006.01)

(52) U.S. Cl. ..... 345/60; 315/169.4

(58) Field of Classification Search ..... 345/60–72; 315/169.1–169.4

See application file for complete search history.

(56) References Cited

U.S. PATENT DOCUMENTS 5,786,794 A * 7/1998 Kishi et al. ..... 345/60
6,175,192 B1 * 1/2001 Moon ..... 315/169.3
6,281,635 B1 * 8/2001 Lee ..... 315/169.4

FOREIGN PATENT DOCUMENTS

JP 2002-062844 2/2002
KR 1020030013613 A 2/2003

* cited by examiner

*Primary Examiner*—Dennis-Doon Chow
(74) *Attorney, Agent, or Firm*—H.C. Park & Associates, PLC

(57) ABSTRACT

An apparatus for driving a plasma display panel includes a first driver and a second driver and a first power supplier and a second power supplier for generating sustain discharge pulses having no negative (–) level. The first driver includes a first capacitor charged to a first voltage and is coupled to a power source for supplying a voltage $V_s$ and a ground voltage. The first driver, coupled to one terminal of a panel capacitor, operates to alternately apply double the voltage $V_s$ formed by the power source and the first capacitor and the ground voltage to the one terminal of the panel capacitor. The second power supplier, coupled to the power source and the ground voltage, includes a second capacitor charged to $V_s$. The second driver coupled to the other terminal of the panel capacitor operates to alternately apply double the voltage $V_s$ formed by the power source and the second capacitor and the ground voltage to the other terminal of the panel capacitor. Here, one of the first driver and the second driver applies the ground voltage to the panel capacitor, while the other applies double the voltage $V_s$ to the panel capacitor.

11 Claims, 13 Drawing Sheets

APPARATUS AND METHOD FOR DRIVING A PLASMA DISPLAY PANEL

BACKGROUND OF THE INVENTION

1. Field of the Invention

The present invention relates to an apparatus and method for driving a plasma display panel. More specifically, the present invention relates to a sustain discharge circuit for plasma display panels.

2. Description of the Related Art

A plasma display panel (PDP) is a flat panel display that uses plasma generated by gas discharge to display characters or images. The PDP includes, according to its size, more than several scores to millions of pixels arranged in a matrix pattern. Such a PDP is classified as a direct current (DC) type or an alternating current (AC) type according to its discharge cell structure and the waveform of the driving voltage applied thereto.

The DC PDP has electrodes exposed to a discharge space to allow DC to flow through the discharge space while voltage is applied, and thus requires a certain resistance for limiting the current. Contrarily, the AC PDP has electrodes covered with a dielectric layer that naturally forms a capacitance component to limit the current and to protect the electrodes from the impact of ions during a discharge, and has longevity superior to the DC PDP.

A driving method of the AC PDP includes a reset step, an addressing step, a sustain discharge step, and an erase step.

In the reset step, each cell is initialized to be ready to perform an addressing operation on the cell. In the addressing step, wall charges are formed on selected "on"-state cells (i.e., addressed cells) in the panel. In the sustain step, a discharge occurs to actually display an image on the addressed cells. In the erase step, the wall charges on the cells are erased to end the sustain discharge.

In the AC PDP, the scan and sustain electrodes for sustain discharge act as a capacitative load to form a capacitance between the scan and sustain electrodes, which is equivalently denoted as a "panel capacitor" hereinafter. Kishi et al. suggested a circuit (Japanese Patent No. 3,201,603) that applies a waveform for a sustain discharge on the scan and sustain electrodes.

In conventional circuits, however, a sustain discharge pulse swinging between positive (+) voltage $V_s$ and negative (−) voltage $-V_s$ is applied to the scan and sustain electrodes. With the sustain discharge pulse applied to the scan electrode and the sustain electrode for phase inversion of each other, the potential difference between the scan electrode and the sustain electrode reaches a voltage of $2V_s$ required for a sustain discharge. Individual elements used in this circuit must have a withstand voltage of $V_s$, so that any element having a low withstand voltage can be used. Such a conventional circuit, however, uses a pulse swinging from $-V_s$ to $V_s$, and it cannot be used for a plasma display panel that uses a sustain discharge pulse with no negative (−) voltage.

SUMMARY OF THE INVENTION

It is an object of the present invention to provide a PDP driver circuit using no negative (−) voltage.

It is another object of the present invention to use a switch having a low withstand voltage.

In order to achieve such objects, an apparatus for driving a PDP includes a plurality of address electrodes, a plurality of scan electrodes and sustain electrodes alternately arranged in pairs, and a panel capacitor formed among the address, scan and sustain electrodes. The driving apparatus comprises a first driver and a second driver, and a first power supplier and a second power supplier.

The apparatus has a capacitor that stores a half voltage level of the sustain voltage. When applying a voltage to one electrode of the panel capacitor, a source voltage that is serially connected to the capacitor is connected to the electrode of the panel capacitors. This forms a circuit path between the source voltage, the capacitor and the electrode of the panel capacitor. Therefore, the summation of the source voltage and the capacitor-stored voltage is applied to the electrode of the panel capacitor.

The other electrode of the panel capacitor is also connected to the same circuitry including a source voltage and a capacitor. A same configuration of circuit is formed when the voltage needs to be applied to the other electrode of the panel capacitor.

The voltages are alternately applied to each electrode of the panel capacitor in this manner. This allows the manufacturer to use a low voltage device in its component, which reduces the costs.

The apparatus may also include a voltage recovery circuit. By including an inductor and a switching device in the circuitry, the apparatus may recover the energy used in the previous discharge phase.

A method for driving such device is also disclosed.

DETAILED DESCRIPTION OF THE PREFERRED EMBODIMENTS

Figure 1:
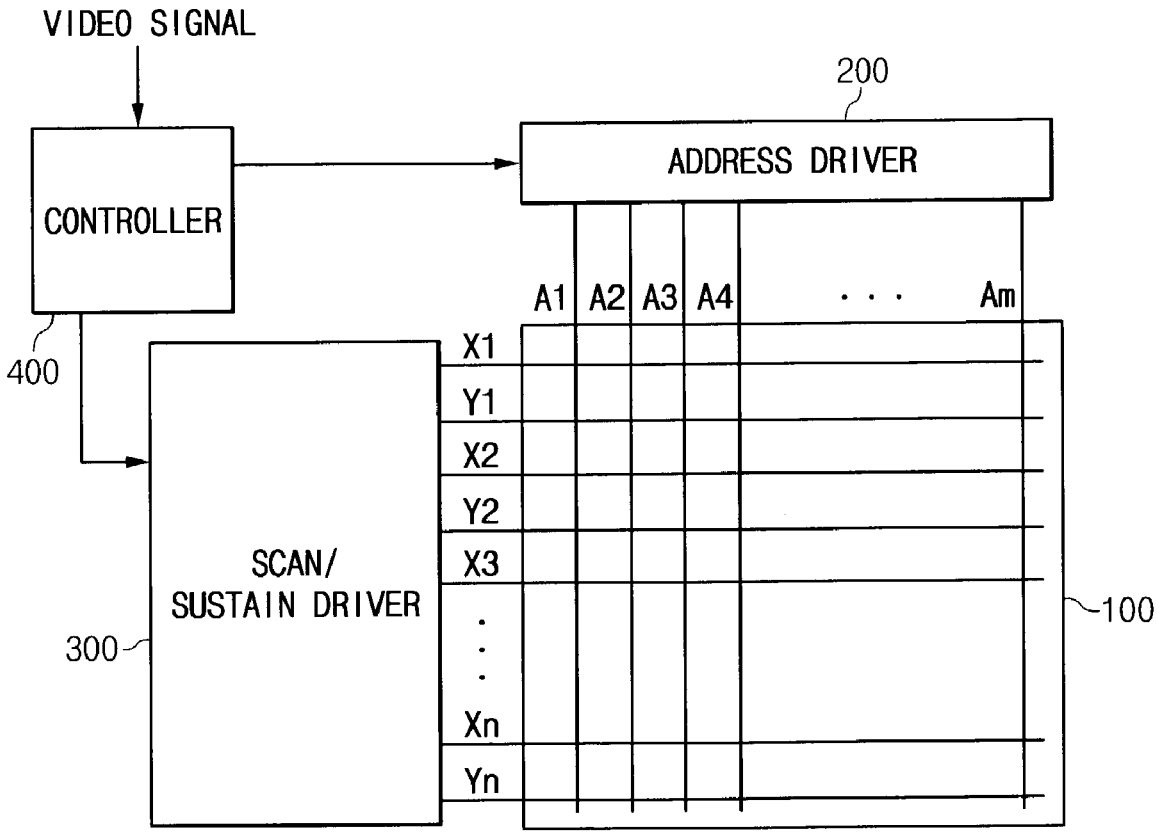
FIG. 1 is an illustration of a PDP according to an embodiment of the present invention.

In the following detailed description, only the preferred embodiment of the invention has been shown and described, simply by way of illustrating the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive. In the figures, some parts not related to the description are omitted for a better understanding of the present invention, and the same reference numerals are assigned to the same parts throughout.

FIG. 1 is an illustration of a PDP according to an embodiment of the present invention.

The PDP according to the embodiment of the present invention comprises a plasma panel 100, an address driver 200, a scan/sustain driver 300, and a controller 400.

The plasma panel 100 comprises a plurality of address electrodes $A_1$ to $A_m$ arranged in rows, and a plurality of scan electrodes (hereinafter referred to as "Y electrodes") $Y_1$ to $Y_n$ and sustain electrodes (hereinafter referred to as "X electrodes") $X_1$ to $X_n$ alternately arranged in columns. The Y electrodes $Y_1$ to $Y_n$ are formed in correspondence with the X electrodes to be alternately arranged in pairs. When the controller 400 receives an external image signal, it generates an address drive control signal and a sustain discharge signal, and applies them to the address driver 200 and the scan/sustain driver 300, respectively.

The address driver 200 receives the address drive control signal from the controller 400 and applies a display data signal, for selection of discharge cells to be displayed, to the individual address electrodes. The scan/sustain driver 300 receives the sustain discharge signal from the controller 400 and applies a sustain discharge pulse alternately to the X and Y electrodes. The applied sustain discharge pulse causes a sustain discharge on the selected discharge cells.

Below is a description of a driver circuit of the scan/sustain driver 300 according to a first embodiment of the present invention with reference to FIGS. 2 to 4.

Figure 2:
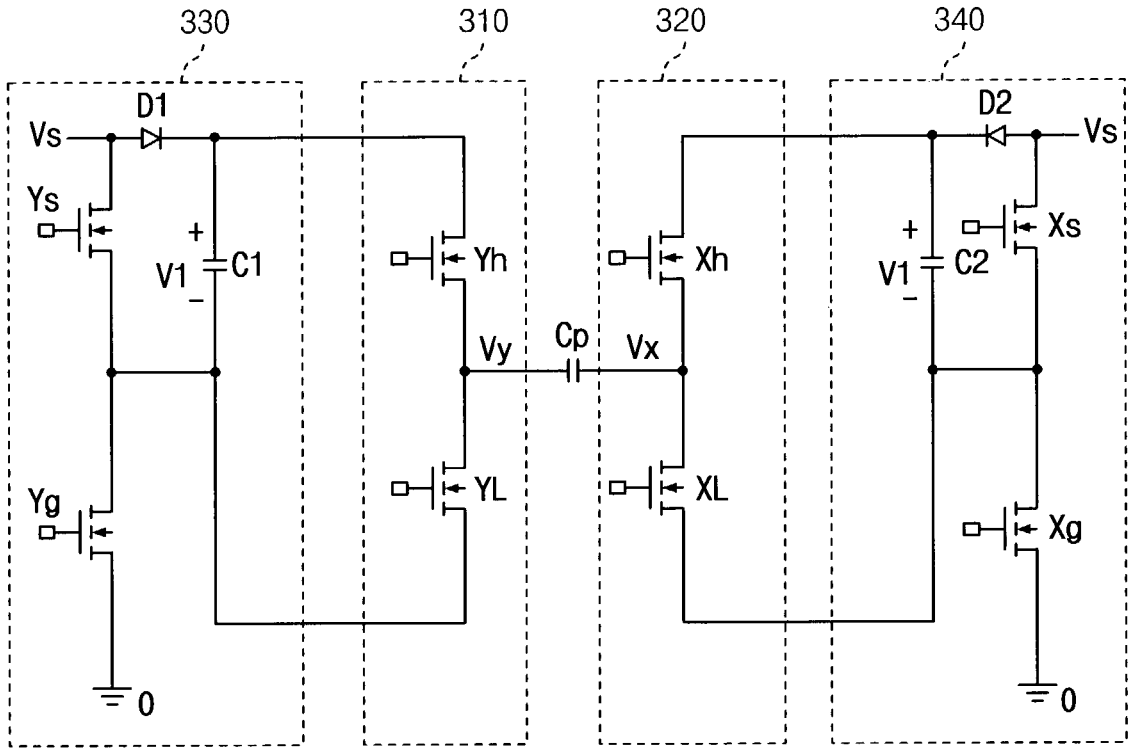
FIG. 2 is a circuit diagram of a driver circuit according to a first embodiment of the present invention.
Figure 3A:
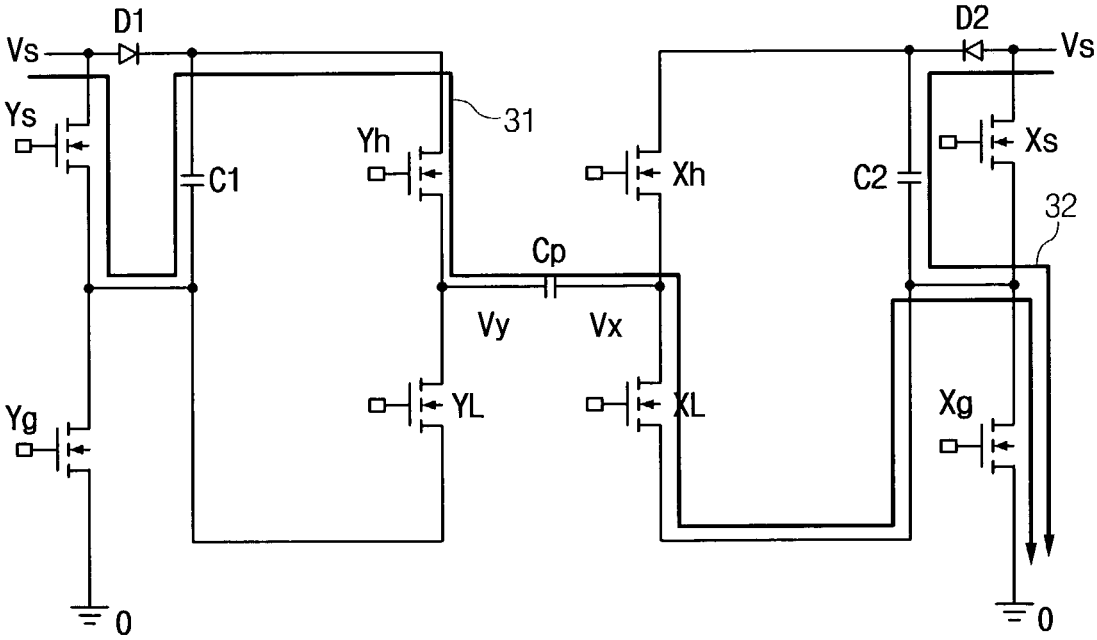
FIGS. 3A and 3B are illustrations showing the current paths in the respective modes for the driver circuit according to the first embodiment of the present invention.
Figure 3B:
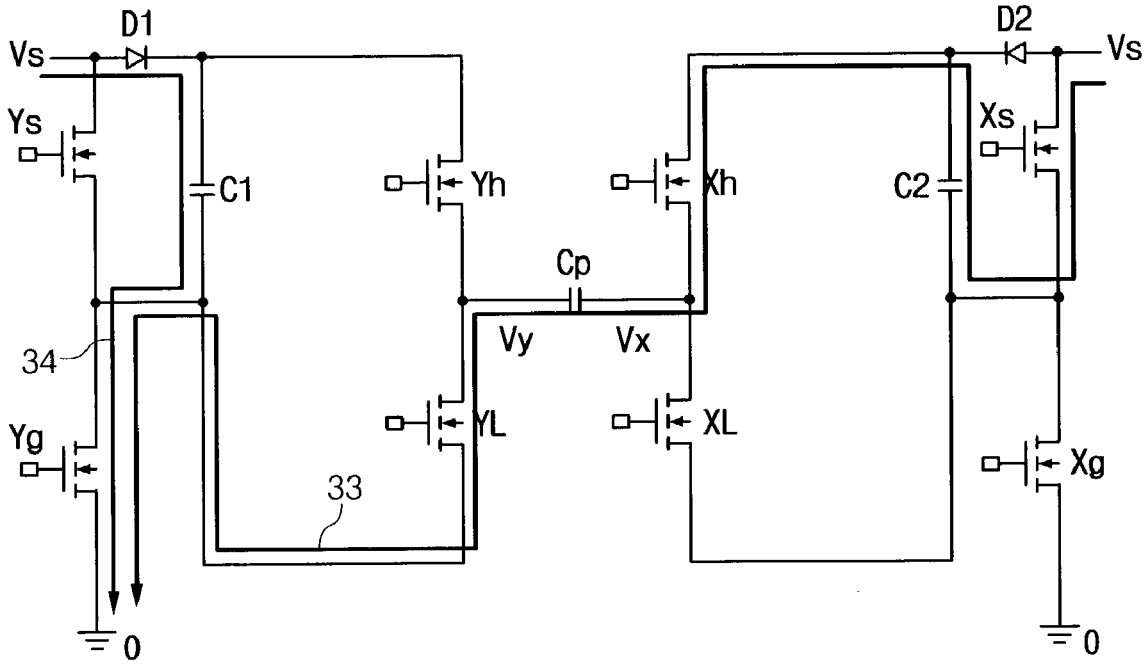
Figure 4:
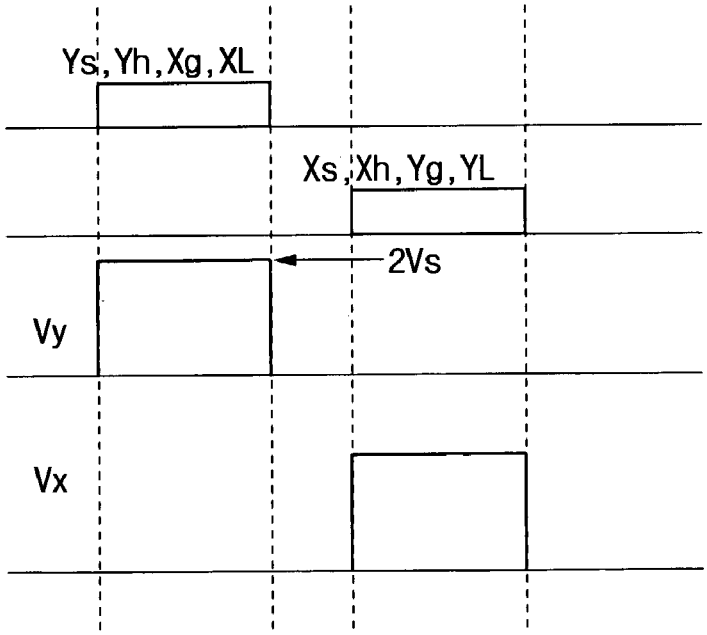
FIG. 4 is a timing diagram of the driver circuit according to the first embodiment of the present invention.

FIG. 2 is a circuit diagram of the driver circuit 300 according to the first embodiment of the present invention, FIGS. 3A and 3B are illustrations showing the current paths in the respective modes for the driver circuit according to the first embodiment of the present invention, and FIG. 4 is a timing diagram of the driver circuit 300 according to the first embodiment of the present invention.

The driver circuit 300 according to the first embodiment of the present invention comprises, as shown in FIG. 2, a Y electrode driver 310, an X electrode driver 320, a Y electrode power supplier 330, and an X electrode power supplier 340.

The Y electrode driver 310 and the X electrode driver 320 are connected to each other with a panel capacitor $C_p$ therebetween. The Y electrode driver 310 comprises switches $Y_h$ and $Y_L$ coupled in parallel to one terminal of the panel capacitor $C_p$, while the X electrode driver 320 comprises switches $X_h$ and $X_L$ coupled in parallel to the other terminal of the panel capacitor $C_p$.

The Y electrode power supplier 330 comprises a capacitor $C_1$, a diode $D_1$, and switches $Y_s$ and $Y_g$. The switches $Y_s$ and $Y_g$ are coupled in series between a power source $V_s$ and a ground terminal 0, and the contact between the switches $Y_s$ and $Y_g$ is coupled to the switch $Y_L$ of the Y electrode driver 310. The diode $D_1$ is coupled between the power source $V_s$ and the switch $Y_h$ of the Y electrode driver 310, and the contact between the diode $D_1$ and the switch $Y_h$ is coupled to the other terminal of the capacitor $C_1$. Therefore, the switches $Y_h$ and $Y_L$ are coupled in series to both terminals of the capacitor $C_1$.

The X electrode power supplier 340 comprises a capacitor $C_2$, a diode $D_2$, and switches $X_s$ and $X_g$. The structure of the X electrode power supplier 340 is readily understandable with reference to the structure of the Y electrode power supplier 330 and FIG. 2, and will not be further described.

Although the switches $Y_h$, $Y_L$, $X_h$, $X_L$, $Y_s$, $Y_g$, $X_s$, and $X_g$ are represented as a MOSFET in FIG. 2, they are not specifically limited to MOSFET and may include any switches that perform the same or similar functions. Preferably, the switches have a body diode such as a PN junction separation structure of a semiconductor integrated circuit.

Below is a description of an operation of the driver circuit according to the first embodiment of the present invention with reference to FIGS. 3A, 3B, and 4. Here, the operation changes in two modes, which are switched by manipulation of the switches $Y_h$, $X_L$, $X_h$, and $Y_L$. It is assumed that the capacitors $C_1$ and $C_2$ are charged to the voltage $V_s$.

First, with the switches $X_s$, $X_h$, $Y_g$, and $Y_L$ off, the switches $Y_s$, $Y_h$, $X_g$, and $X_L$ are turned on to form a current path 31.

When the switches $Y_s$ and $Y_h$ are turned on, the voltage of the power source $V_s$ and the voltage $V_s$ charged on the capacitor $C_1$ are applied to the Y electrodes of the panel capacitor $C_p$ by the current path of power source $V_s$, switch $Y_s$, capacitor $C_1$, and switch $Y_h$. The applied voltage makes a Y electrode voltage $V_y$ of the panel capacitor $C_p$ reach $2V_s$. Also, an X electrode voltage $V_x$ of the panel capacitor $C_p$ reaches the ground voltage 0V by a current path of switch $X_L$ and $X_g$.

In addition, the capacitor $C_2$ is continuously charged to the voltage $V_s$ by a current path 32 of power source $V_s$, diode $D_2$, capacitor $C_2$, switch $X_g$, and ground terminal 0.

Subsequently, the switches $Y_s$, $Y_h$, $X_g$, and $X_L$ are turned off and the switches $X_s$, $X_h$, $Y_g$, and $Y_L$ are turned on, to form a current path 33.

When the switches $X_s$ and $X_h$ are turned on, the voltage of the power source $V_s$ and the voltage $V_s$ charged on the capacitor $C_2$ are applied to the X electrodes of the panel capacitor $C_p$ by the current path of power source $V_s$, switch $X_s$, capacitor $C_2$, and switch $X_h$. The applied voltage makes the X electrode voltage $V_x$ of the panel capacitor $C_p$ reach $2V_s$. Also, the Y electrode voltage $V_y$ of the panel capacitor $C_p$ reaches the ground voltage 0V by a current path of switches $Y_L$ and $Y_g$.

In addition, capacitor $C_1$ is charged to the voltage $V_s$ by a current path 34 of power source $V_s$, diode $D_1$, capacitor $C_1$, switch $Y_g$, and ground terminal 0.

According to the first embodiment of the present invention, as described above, the potential difference between the X and Y electrodes can be a sustain discharge voltage $2V_s$ by generating a sustain discharge pulse swinging from zero to $2V_s$.

The driver circuit 300 according to the first embodiment of the present invention may include a power recovery circuit for recovering reactive power and reusing it. Below is a description of an embodiment with the addition of a power recovery circuit, with reference to FIGS. 5 to 7.

Figure 5:
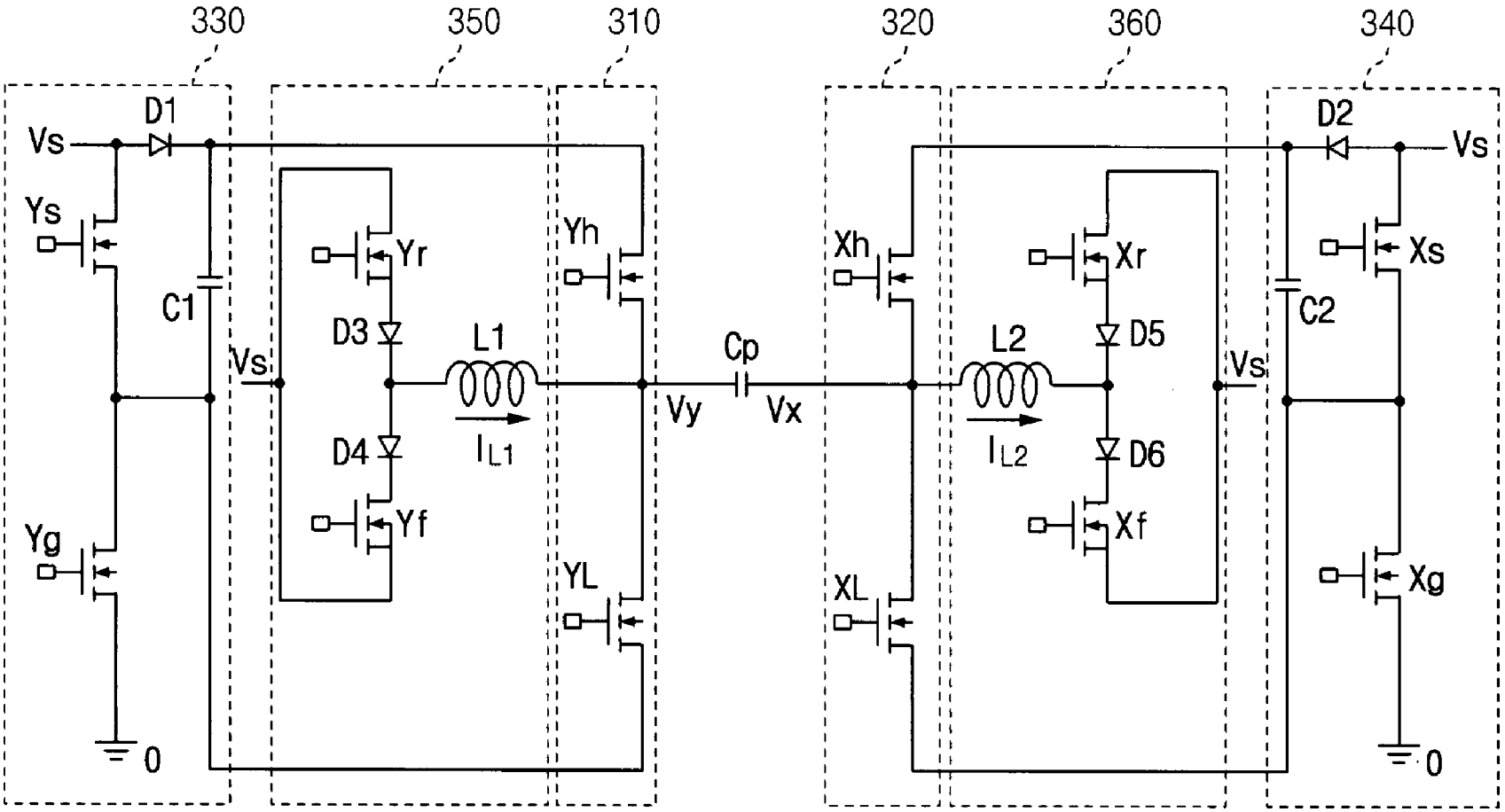
FIG. 5 is a circuit diagram of a driver circuit according to a second embodiment of the present invention.
Figure 6A:
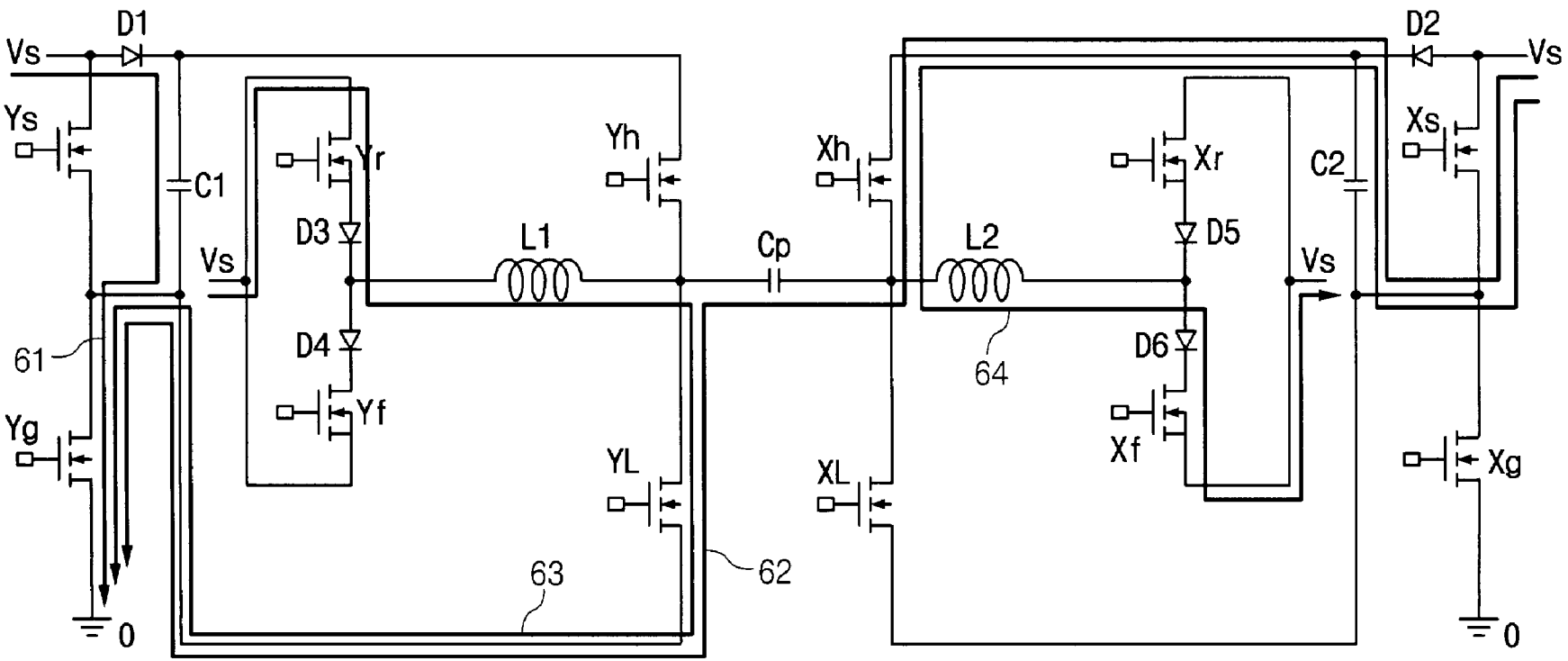
FIGS. 6A through 6H are illustrations showing the current paths in the respective modes for the driver circuit according to the second embodiment of the present invention.
Figure 6B:
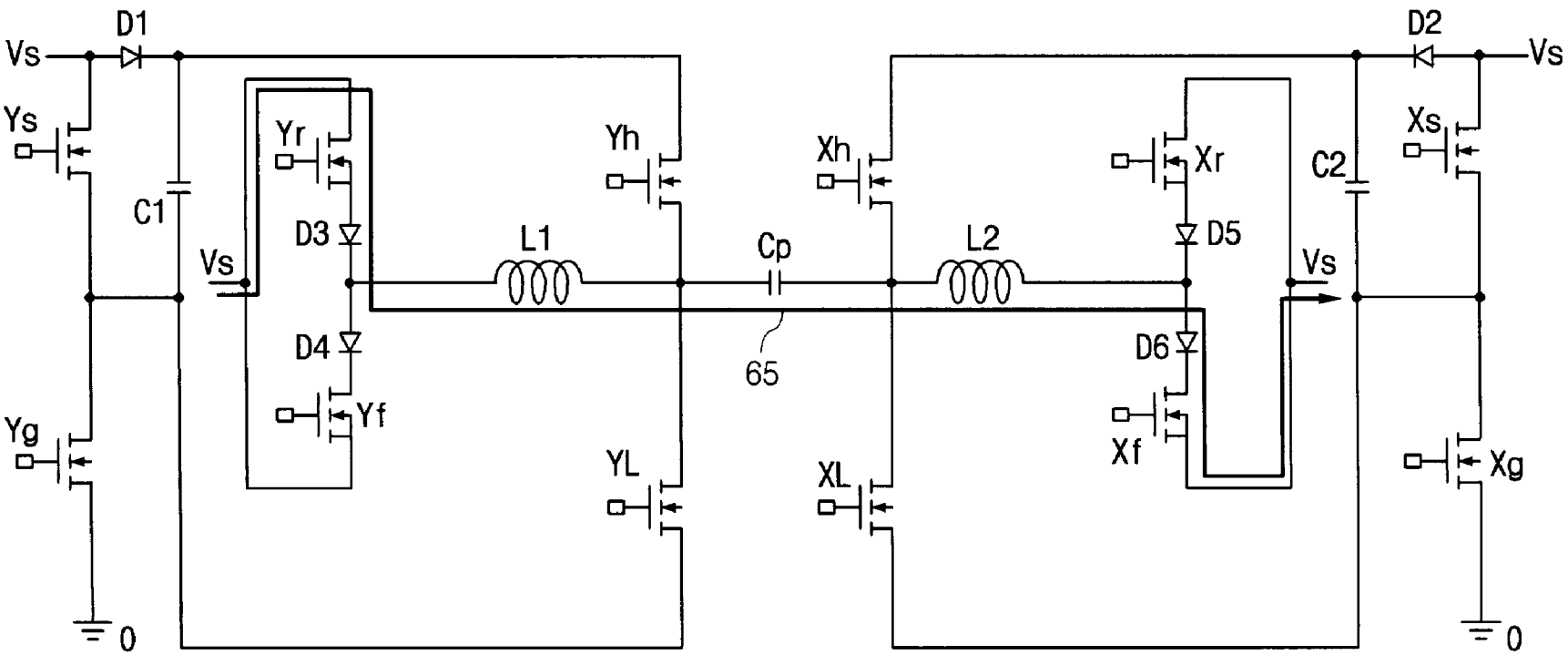
Figure 6C:
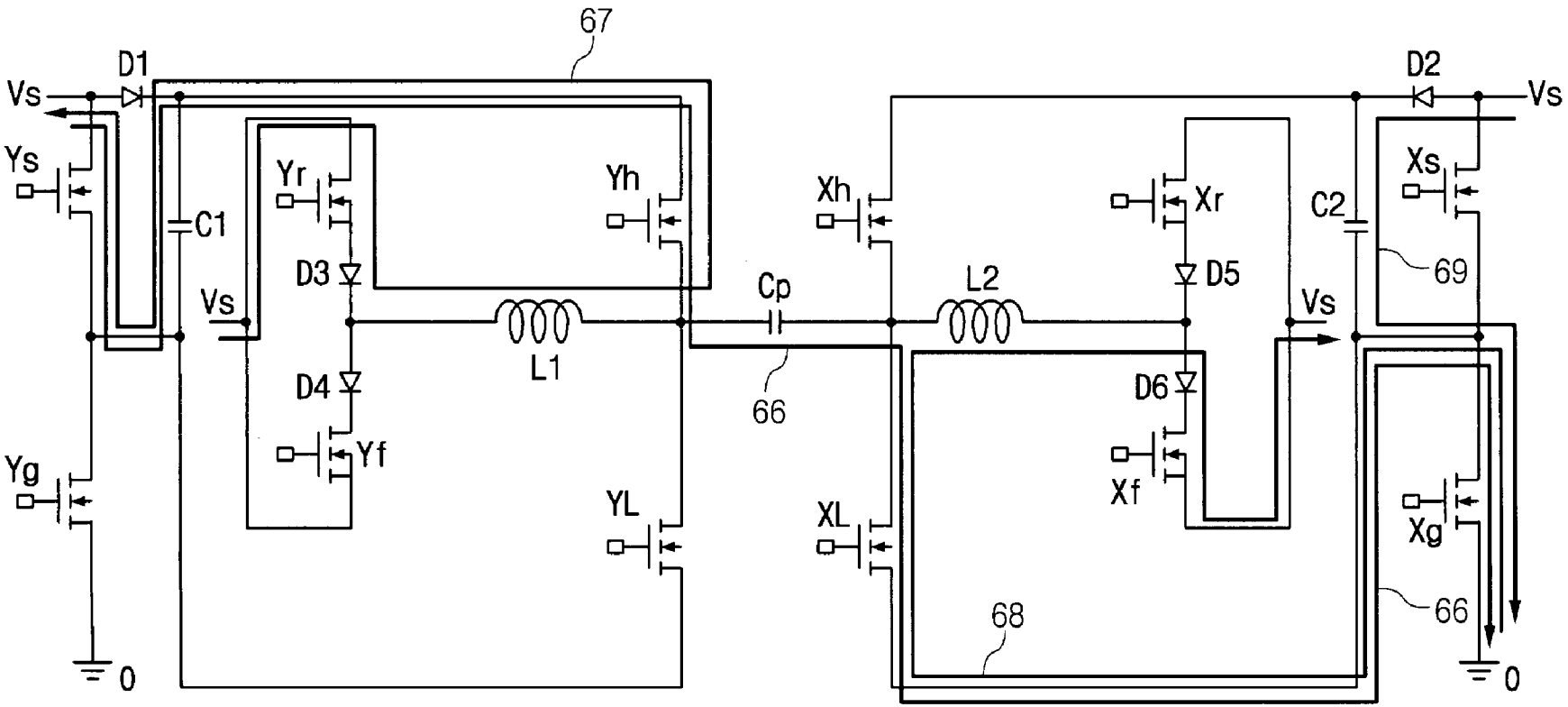
Figure 6D:
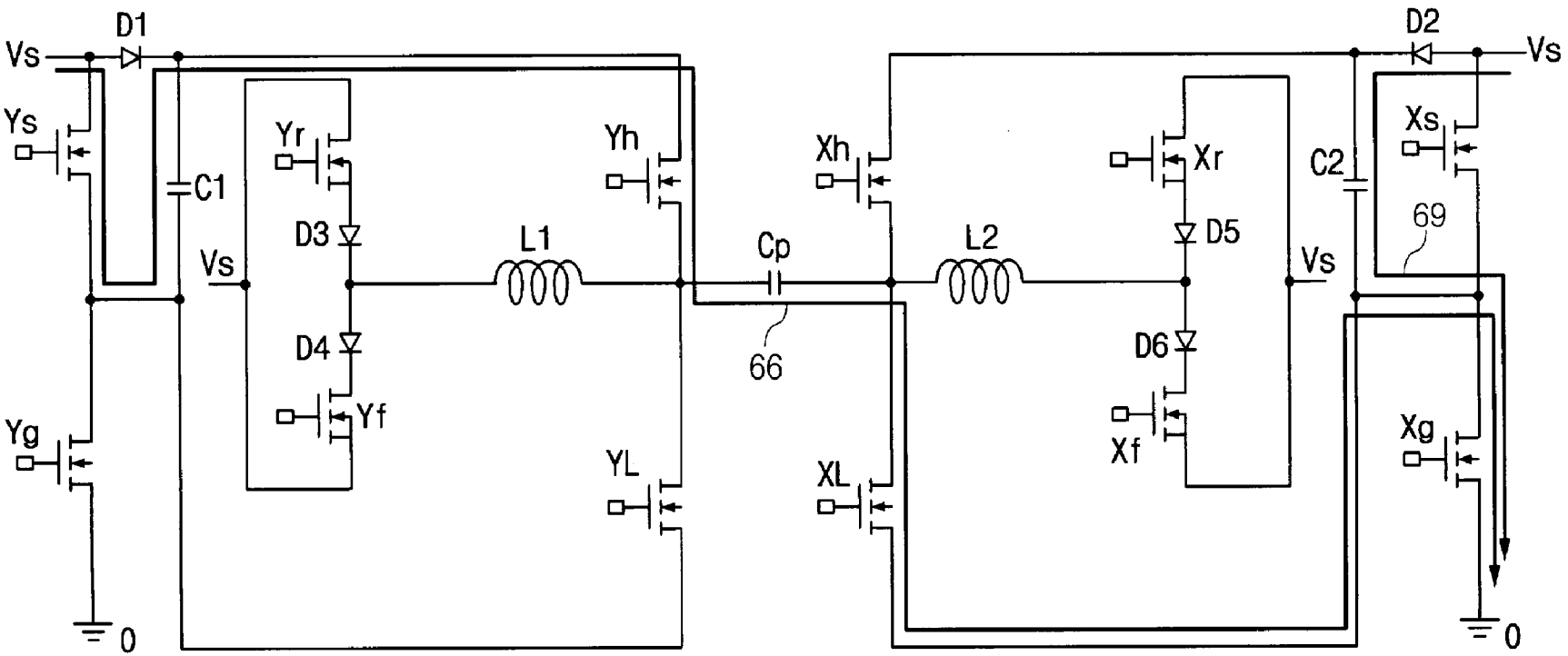
Figure 6E:
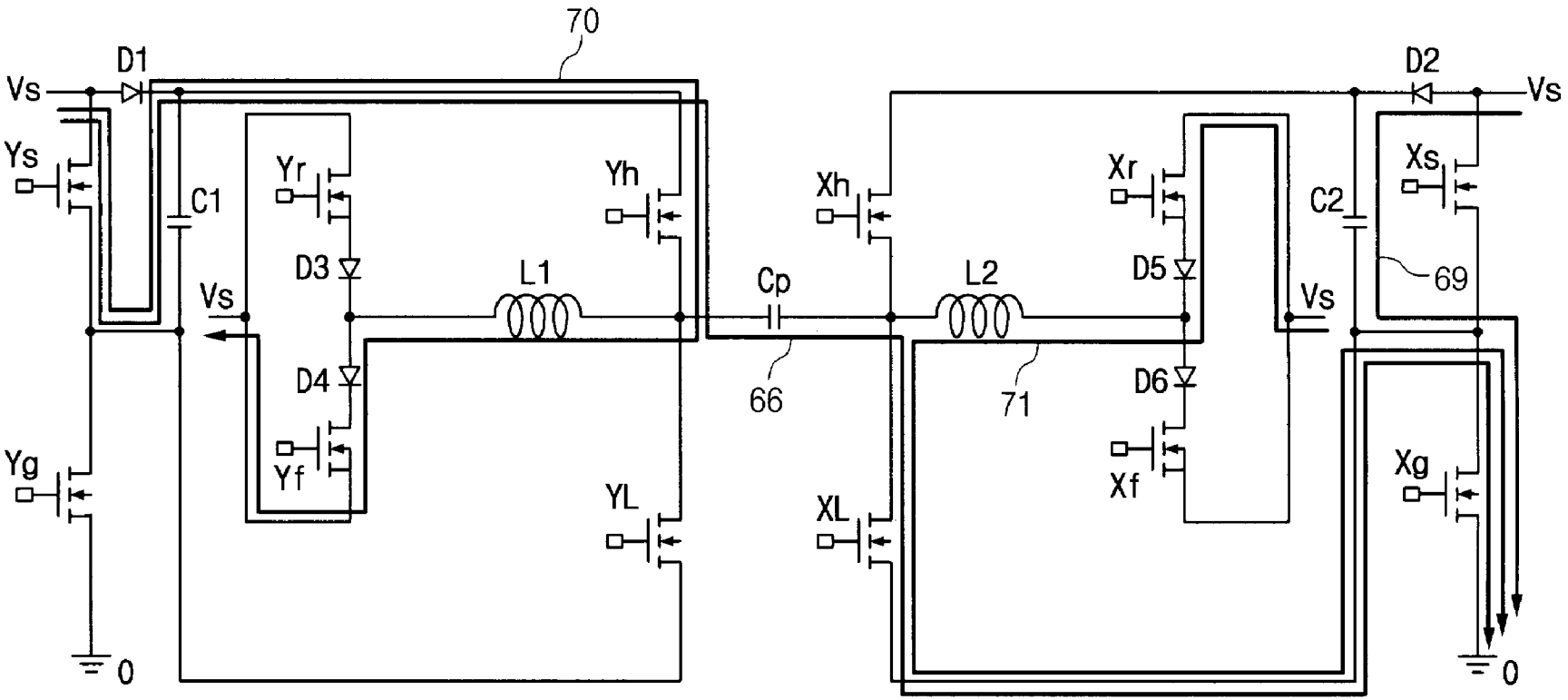
Figure 6F:
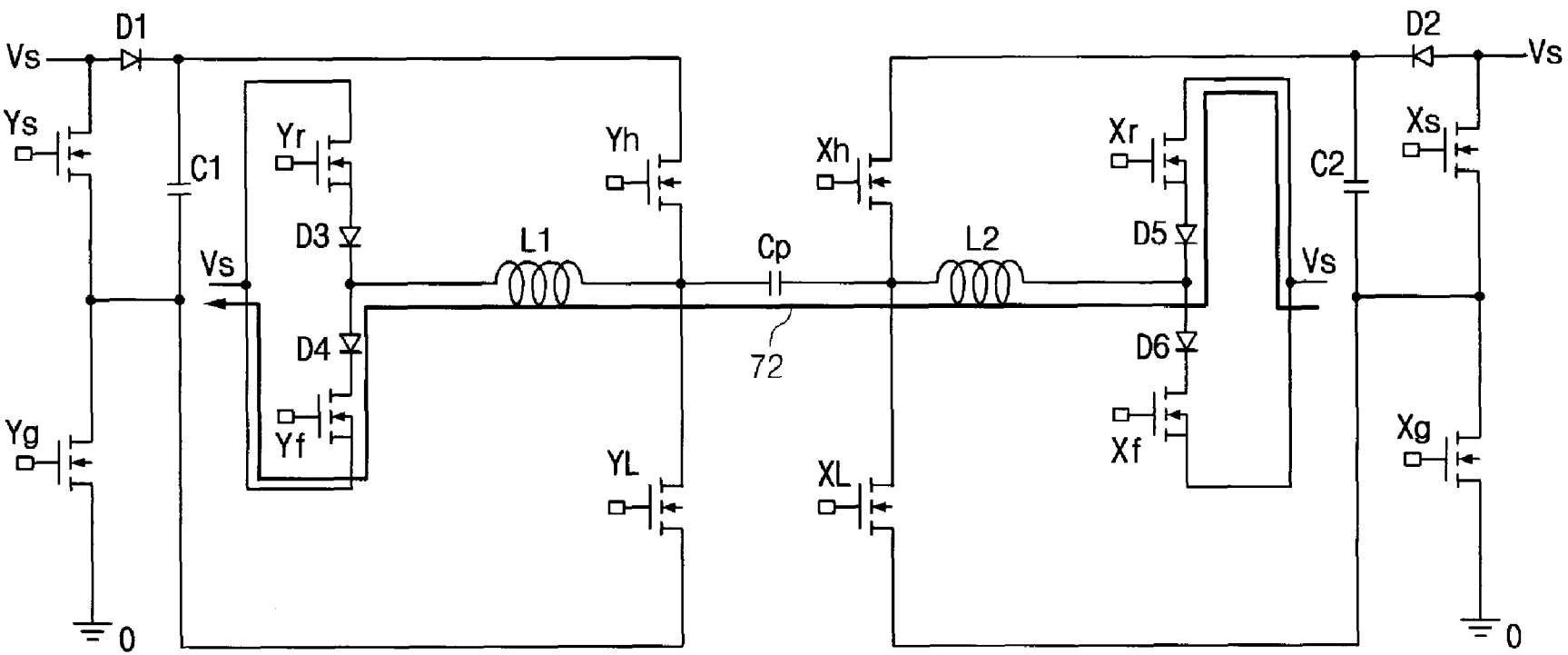
Figure 6G:
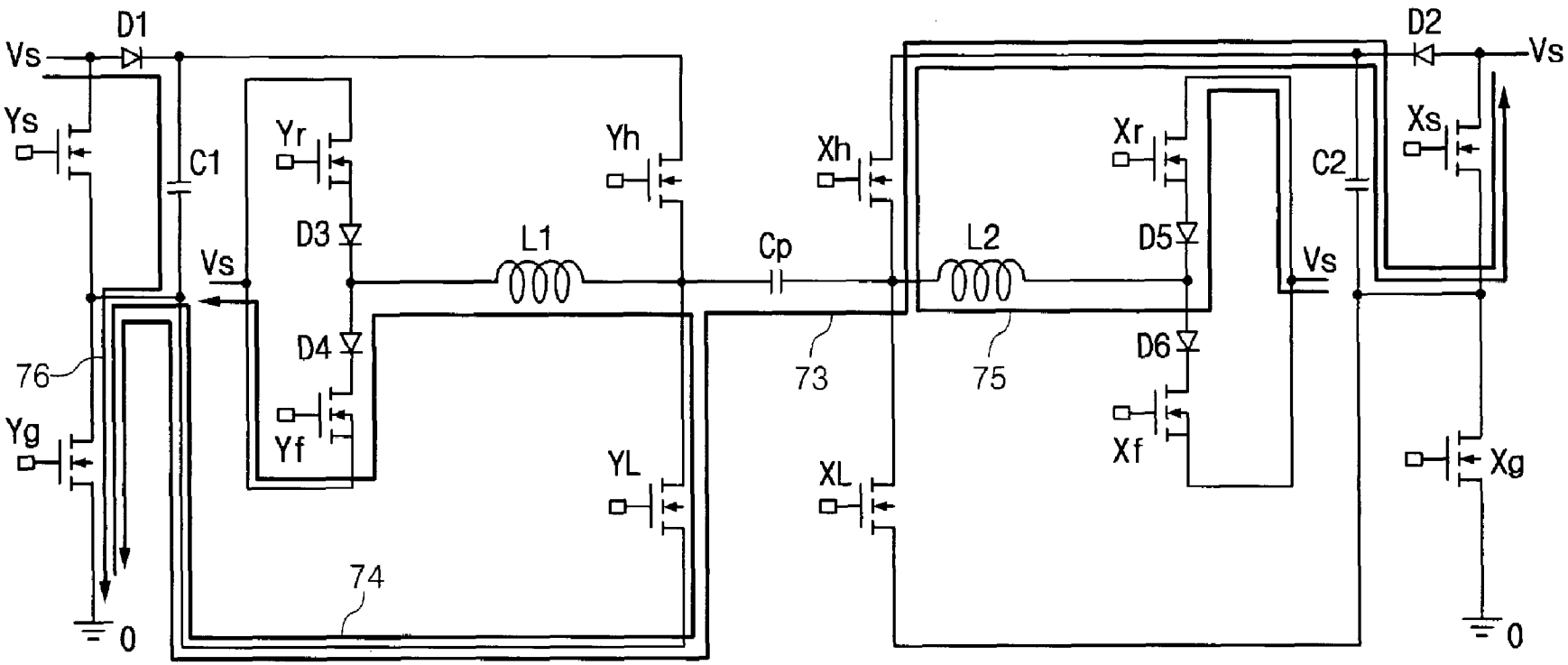
Figure 6H:
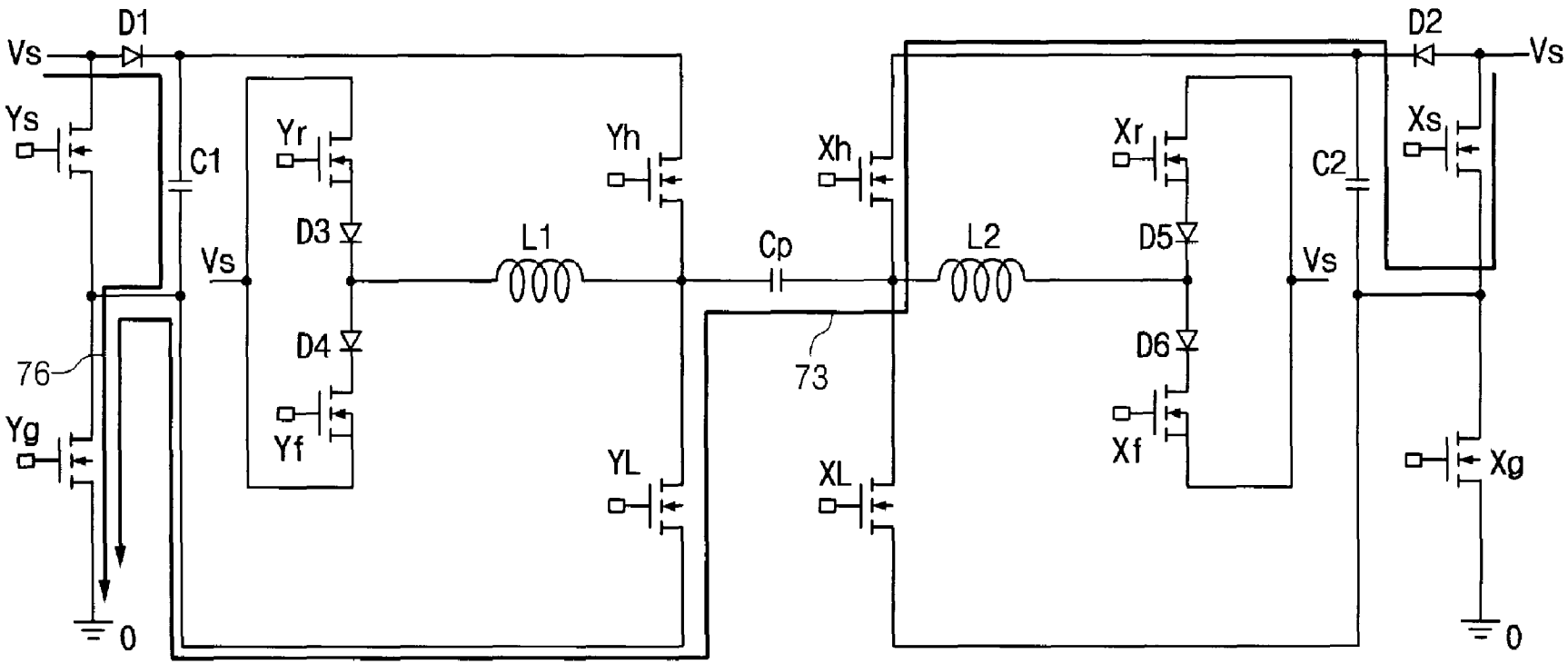
Figure 7:
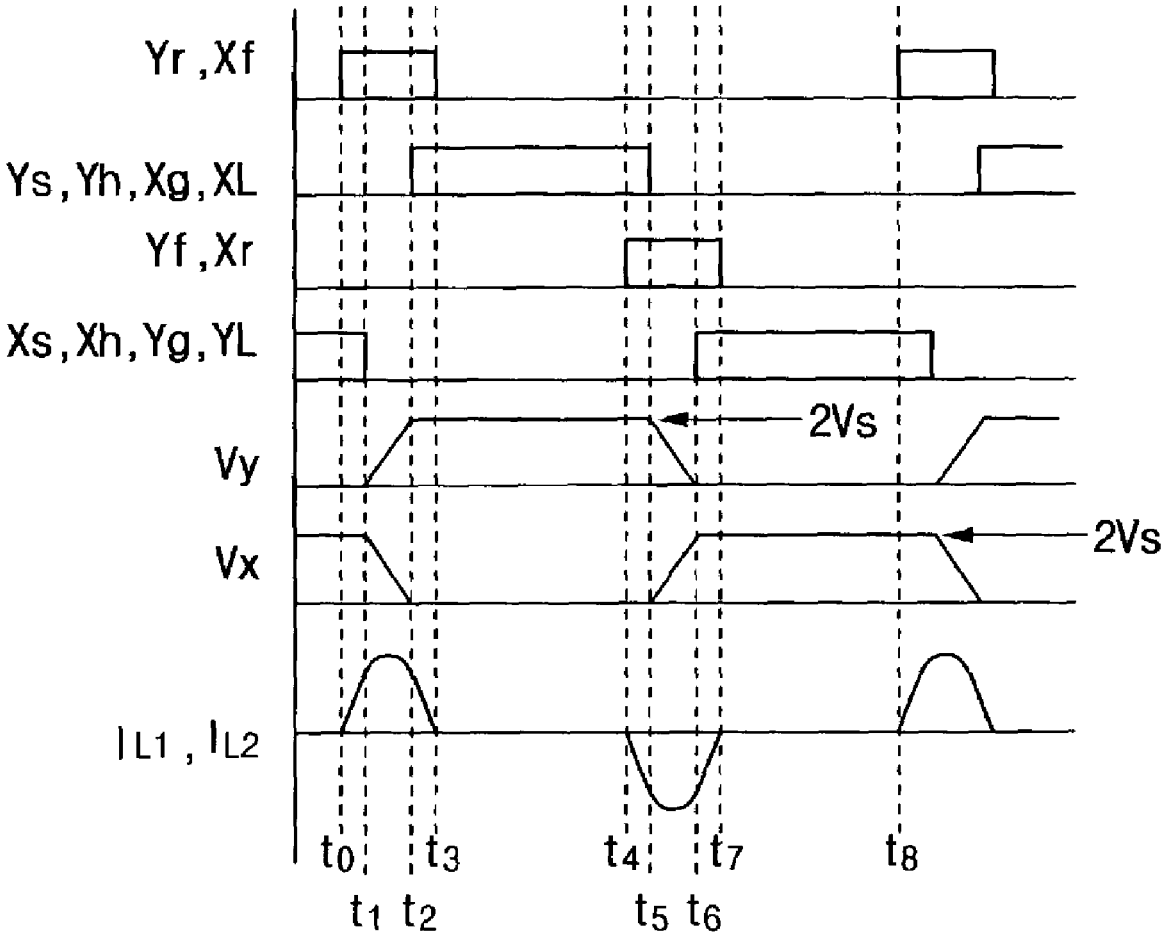
FIG. 7 is a timing diagram of the driver circuit according to the second embodiment of the present invention.

FIG. 5 is a circuit diagram of the driver circuit according to a second embodiment of the present invention, FIGS. 6A to 6H are illustrations showing the current paths in the respective modes for the driver circuit according to the second embodiment of the present invention, and FIG. 7 is a timing diagram of the driver circuit according to the second embodiment of the present invention.

The driver circuit 300 according to the second embodiment of the present invention comprises, as shown in FIG. 5, Y electrode power recovery section 350 and X electrode power recovery section 360 added to the driver circuit of the first embodiment of the present invention.

The Y electrode power recovery section 350 comprises an inductor $L_1$ and switches $Y_r$ and $Y_f$. The inductor $L_1$ has one terminal coupled to a contact between the switches $Y_h$ and $Y_L$, i.e., the Y electrode of the panel capacitor $C_p$. The switches $Y_r$ and $Y_f$ are coupled in parallel between the other terminal of the inductor $L_1$ and the power source $V_s$. The Y electrode power recovery section 350 may further comprise diodes $D_3$ and $D_4$ coupled between the switches $Y_r$ and $Y_f$ and the inductor $L_1$, respectively. The diodes $D_3$ and $D_4$ form a current path to the inductor $L_1$ and a current path from the inductor $L_1$.

The X electrode power recovery section 360 comprises an inductor $L_2$ and switches $X_r$ and $X_f$, and further diodes $D_5$ and $D_6$. The structure of the X electrode power recovery section 360 is the same as that of the Y electrode power recovery section 350 and will not be further described. The switches $Y_r$, $Y_f$, $X_r$, and $X_f$ may comprise MOSFETs.

Below is a description of an operation of the driver circuit according to the second embodiment of the present invention with reference to FIGS. 6A through 6H and 7. Here, the operation changes in eight modes, which are switched by manipulation of switches. The phenomenon called "LC resonance" herein, is not a continuous oscillation but a change in voltage and current caused by the combination of the inductors $L_1$ and $L_2$ and the panel capacitor $C_p$ when the switches $Y_r$, $X_f$, $X_r$, and $Y_f$ are turned on.

In the second embodiment of the present invention, it is assumed that before the start of Mode 1, the switches $X_s$, $X_h$, $Y_g$, and $Y_L$ are in the "on" position, with the switches $Y_s$, $Y_h$, $X_g$, $X_L$, $Y_f$, $X_r$, $Y_r$, and $X_f$ off. It is also assumed that the capacitors $C_1$ and $C_2$ are charged to a voltage of $V_s$ and that the inductance of the inductors $L_1$ and $L_2$ is L.

(1) Mode 1 (t0 to t1)

Reference will be made to FIG. 6A and the t0–t1 interval of FIG. 7 to describe the operation in Mode 1.

Before the start of Mode 1, the capacitor $C_1$ is charged to a voltage of $V_s$ by a current path including power source $V_s$, diode $D_1$, capacitor $C_1$, and switch $Y_g$. Also, a current path 62 is formed that includes power source $V_s$, switch $X_s$, capacitor $C_2$, switch $X_h$, panel capacitor $C_p$, switch $Y_L$, switch $Y_g$, and ground voltage. Then, due to the power source $V_s$ and the voltage of $V_s$ charged on the capacitor $C_2$, the X electrode voltage $V_x$ of the panel capacitor $C_p$ is sustained at $2V_s$. As the Y electrode is coupled to the ground voltage, the Y electrode voltage $V_y$ is sustained at 0V.

Here, turning on the switches $Y_r$ and $X_f$ forms a current paths 63 and 64. The current path 63 includes power source $V_s$, switch $Y_r$, diode $D_3$, inductor $L_1$, switch $Y_L$, switch $Y_g$, and ground voltage. A current path 64 includes power source $V_s$, switch $X_s$, capacitor $C_2$, switch $X_h$, inductor $L_2$, diode $D_6$, switch $X_f$, and power source $V_s$. By the current paths 63 and 64, currents $IL_1$ and $IL_2$ flowing to the inductors $L_1$ and $L_2$ linearly increase with a slope of $V_s/L$ and $(2V_s-V_s)/L$ $(=V_s/L)$, respectively. Hence the energy is stored in the inductors $L_1$ and $L_2$ due to the currents $IL_1$ and $IL_2$.

(2) Mode 2 (t1 to t2)

Reference will be made to FIG. 6B and the t1–t2 interval of FIG. 7 to describe the operation in Mode 2.

In Mode 2, with the switches $Y_r$ and $X_f$ on, the switches $X_s$, $X_h$, $Y_g$, and $Y_L$ are turned off. Then, a current path 65 is formed that includes power source $V_s$, switch $Y_r$, diode $D_3$, inductor $L_1$, panel capacitor $C_p$, inductor $L_2$, diode $D_6$, switch $X_f$, and power source $V_s$, so that an LC resonance current flows due to the inductors $L_1$ and $L_2$ and the panel capacitor $C_p$. With this LC resonance current, the Y electrode voltage $V_y$ of the panel capacitor $C_p$ is increased to $2V_s$, and the X electrode voltage $V_x$ is reduced to 0V. Therefore, the energy stored in the inductors $L_1$ and $L_2$ is used to change the Y and X electrode voltages of the panel capacitor $C_p$.

(3) Mode 3 (t2~t3)

Reference will be made to FIG. 6C and the t2–t3 interval of FIG. 7 to describe the operation in Mode 3.

In Mode 3, with the switches $Y_r$ and $X_f$ on, the switches $Y_s$, $Y_h$, $X_g$, and $X_L$ are turned on. A current path 66 is then formed that includes power source $V_s$, switch $Y_s$, capacitor $C_1$, switch $Y_h$, panel capacitor $C_p$, switch $X_L$, switch $X_g$, and ground voltage. Due to the power source $V_s$ and the voltage of $V_s$ charged on the capacitor $C_1$, the Y electrode voltage $V_y$ of the panel capacitor $C_p$ is sustained at $2V_s$. As the X electrode is coupled to the ground voltage, the X electrode voltage $V_x$ is sustained at 0V.

A current path 67 is formed that includes power source $V_s$, switch $Y_r$, diode $D_3$, inductor $L_1$, the body diode of switch $Y_h$, capacitor $C_1$, the body diode of switch $Y_s$, and power source $V_s$. Also, a current path 68 is formed that includes ground voltage, the body diode of switch $X_g$, the body diode of switch $X_L$, inductor $L_2$, diode $D_6$, switch $X_f$, and power source $V_s$. By the current paths 67 and 68, currents flowing to the inductors $L_1$ and $L_2$ linearly decrease to zero with a slope of $(V_s-2V_s)L$ and $(0-V_s)/L$, i.e., $-V_s/L$, respectively. Hence the energy stored in the inductors $L_1$ and $L_2$ is recovered to the power source $V_s$.

In addition, a current path 69 is formed that includes another power source $V_s$, diode $D_2$, capacitor $C_2$, switch $X_g$, and ground voltage, thereby charging a voltage of $V_s$ on the capacitor $C_2$.

(4) Mode 4 (t3~t4)

Reference will be made to FIG. 6D and the t3–t4 interval of FIG. 7 to describe the operation in Mode 4.

In Mode 4, with the switches $Y_s$, $Y_h$, $X_g$, and $X_L$ on, the switches $Y_r$ and $X_f$ are turned off. By the current path 66 formed in Mode 3, the Y and X electrode voltages $V_y$ and $V_x$ of the panel capacitor $C_p$ are still sustained at $2V_s$ and 0V, respectively. The capacitor $C_2$ is continuously charged to the voltage of $V_s$ by the current path 69 formed in Mode 3.

(5) Mode 5 (t4~t5)

Reference will be made to FIG. 6E and the t4–t5 interval of FIG. 7 to describe the operation in Mode 5.

In Mode 5, with the switches $Y_s$, $Y_h$, $X_g$, and $X_L$ on, the switches $Y_f$ and $X_r$ are turned on. By the current paths 66 and 69 formed in Mode 3, the Y and X electrode voltages $V_y$ and $V_x$ of the panel capacitor $C_p$ are sustained at $2V_s$ and 0V, respectively, and the capacitor $C_2$ is still charged to the voltage of $V_s$.

With the switches $Y_f$ and $X_r$ on, a current path 70 is formed that includes power source $V_s$, switch $Y_s$, capacitor $C_1$, switch $Y_h$, inductor $L_1$, diode $D_4$, switch $Y_f$, and power source $V_s$, and a current path 71 is formed that includes power source $V_s$, switch $X_r$, diode $D_5$, inductor $L_2$, switch $X_L$, switch $X_g$, and ground voltage. By the current paths 70 and 71, the currents $IL_1$ and $IL_2$ flowing to the inductors $L_1$ and $L_2$ are linearly decreased from zero with a slope of $(2V_s-V_s)L$ and $(V_s-0)/L$, i.e., $V_s/L$, respectively (these currents are opposite in direction to those in Mode 1 and are denoted as a negative (–) value in FIG. 7). Hence the energy is stored in the inductors $L_1$ and $L_2$.

(6) Mode 6 (t5 to t6)

Reference will be made to FIG. 6F and the t5–t6 interval of FIG. 7 to describe the operation in Mode 6.

In Mode 6, with the switches $Y_f$ and $X_r$ on, the switches $Y_s$, $Y_h$, $X_g$, and $X_L$ are turned off. The current paths 66, 69, 70, and 71 formed in Mode 5 are then stopped, to form a current path 72 that includes power source $V_s$, switch $X_r$, diode $D_5$, inductor $L_2$, panel capacitor $C_p$, inductor $L_1$, diode $D_4$, switch $Y_f$, and power source $V_s$. The current path 72 makes an LC resonance current flow due to the inductors $L_1$ and $L_2$ and the panel capacitor $C_p$. With this LC resonance current, the Y electrode voltage $V_y$ of the panel capacitor $C_p$ decreases to zero and the X electrode voltage $V_x$ increases to $2V_s$. That is, the energy stored in the inductors $L_1$ and $L_2$ is used to change the Y and X electrode voltages of the panel capacitor $C_p$.

(7) Mode 7 (t6~t7)

Reference will be made to FIG. 6G and the t6–t7 interval of FIG. 7 to describe the operation in Mode 7.

In Mode 7, with the switches $Y_f$ and $X_r$ on, the switches $X_s$, $X_h$, $Y_g$, and $Y_L$ are turned on. A current path 73 is then formed that includes power source $V_s$, switch $X_s$, capacitor $C_2$, switch $X_h$, panel capacitor $C_p$, switch $Y_L$, switch $Y_g$, and ground voltage. This sustains the Y and X electrode voltages $V_y$ and $V_x$ of the panel capacitor $C_p$ at 0V and $2V_s$, respectively.

Then, a current path 74 is formed that includes ground voltage, the body diode of switch $Y_g$, the body diode of switch $Y_L$, inductor $L_1$, diode $D_4$, switch $Y_f$, and power source $V_s$, and a current path 75 is formed that includes power source $V_s$, switch $X_r$, diode $D_5$, inductor $L_2$, the body diode of switch $X_h$, capacitor $C_2$, the body diode of switch $X_s$, and power source $V_s$. By the current paths 74 and 75, currents flowing to the inductors $L_1$ and $L_2$ linearly decrease to zero with a slope of $-V_s/L$ (these currents are opposite in direction to those in Mode 3 and are denoted as a negative (−) value in FIG. 7). Therefore, the energy stored in the inductors $L_1$ and $L_2$ is recovered to the power source $V_s$.

In addition, a current path 76 is formed that includes power source $V_s$, diode $D_1$, capacitor $C_1$, switch $Y_g$, and ground voltage, thereby charging a voltage of $V_s$ on the capacitor $C_1$.

(8) Mode 8 (t7~t8)

Reference will be made to FIG. 6H and the t7–t8 interval of FIG. 7 to describe the operation in Mode 8.

In Mode 8, with the switches $X_s$, $X_h$, $Y_g$, and $Y_L$ on, the switches $Y_f$ and $X_r$ are turned off. By the current path 73 formed in Mode 7, the Y and X electrode voltages $V_y$ and $V_x$ of the panel capacitor $C_p$ are still sustained at 0V and $2V_s$, respectively. The capacitor $C_1$ is continuously charged to the voltage of $V_s$ by the current path 76 formed in Mode 7.

Subsequently, the cycle of Modes 1 to 8 is repeated to generate a sustain discharge pulse having no negative (−) level, thereby providing a potential difference between the X and Y electrodes as a sustain discharge voltage of $2V_s$.

Although each of the Y electrode power recovery sections 350 and X electrode power recovery section 360 has one inductor in the second embodiment of the present invention, other differently modified power recovery sections may be used. For example, the Y electrode power recovery section 350 may include inductors $L_{11}$ and $L_{12}$, each forming a different path. That is, energy is stored in the inductor $L_{11}$ while the Y electrode voltage is sustained at $2V_s$, and it is then used to change the Y electrode voltage to 0V. The energy stored in the inductor $L_{12}$ is recovered while the Y electrode voltage is sustained at 0V, and energy is stored in the inductor $L_{12}$ and then used to change the Y electrode voltage to $2V_s$.

As described above, according to the present invention, only the power source $V_s$ supplying a voltage of $V_s$ is used to generate a sustain discharge pulse swinging from 0V to $2V_s$, thereby making it possible to use conventional switches having a low withstand voltage and to generate a sustain discharge pulse having no negative (−) level.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

The invention claimed is:

1. An apparatus for driving a plasma display panel that includes a plurality of address electrodes, a plurality of scan electrodes and sustain electrodes alternately arranged in pairs, and a panel capacitor formed among the address electrode, scan electrode and the sustain electrode, the apparatus comprising:

a first driver including a first switch and a second switch coupled in parallel to one terminal of the panel capacitor; and a first power supplier including a third switch and a fourth switch coupled in series between a first power source for supplying a first voltage and a second power source for supplying a second voltage, and having a contact thereof coupled to the second switch, a first diode coupled between the first power source and the first switch, and a first capacitor coupled between a contact between the first diode and the first switch and a contact between the third switch and the fourth switch.

2. The apparatus of claim 1, wherein each of the first switch, the second switch, the third switch and the fourth switch has a body diode.

3. The apparatus of claim 1, wherein the first voltage is a half of the voltage required for a sustain discharge and the second voltage is a ground voltage.

4. The apparatus as claimed in claim 1, further comprising:

a second driver including a fifth switch and a sixth switch coupled in parallel to another terminal of the panel capacitor;

a second power supplier including a seventh switch and eighth switch coupled in series between the first power source and the second power source and having a contact thereof coupled to the sixth switch, a second diode coupled between the first power source and the fifth switch, and a second capacitor coupled between a contact between the second diode and the fifth switch and a contact between a seventh switch and an eighth switch.

5. An apparatus for driving a plasma display panel that includes a plurality of address electrodes, a plurality of scan and sustain electrodes alternately arranged in pairs, and a panel capacitor formed among the address, scan and sustain electrodes, the apparatus comprising:

a first power supplier coupled between a first power source and a second power source for supplying a first voltage and a second voltage, respectively, the first power supplier including a first capacitor charged to a third voltage; and a first driver coupled to one terminal of the panel capacitor and operating to alternately apply a summation of the first voltage and the third voltage formed by the first power source and the first capacitor and the second voltage to the one terminal of the panel capacitor.

6. The apparatus of claim 5, wherein the first power supplier further includes a first switch coupled between the first capacitor and the second power source and operating to charge the first capacitor with the third voltage.

7. The apparatus of claim 5, wherein the first power supplier further includes a first switch operating to couple the first capacitor charged to the third voltage in series to the first power source.

8. The apparatus as claimed in claim 5, further comprising:

a second power supplier including a second capacitor charged to the third voltage, the second power supplier being coupled between the first and second power sources; and a second driver coupled to the other terminal of the panel capacitor and operating to alternately apply a summation of the first voltage and the third voltage formed by the first power source and the second capacitor and the second voltage to another terminal of the panel capacitor, wherein one of the first driver and the second driver applies the second voltage to the panel capacitor while the other applies the summation of the first voltage and the third voltage to the panel capacitor.

9. The apparatus as claimed in claim 8, wherein the second power supplier charges the second capacitor with the third voltage while the first driver applies the summation of the first voltage and the third voltage to the one terminal of the panel capacitor; and the first power supplier charges the first capacitor with the third voltage while the second driver applies the summation of the first voltage and the third voltage to the other terminal of the panel capacitor.

10. A method for driving a plasma display panel that includes a plurality of address electrodes, a plurality of scan electrodes and sustain electrodes alternately arranged in pairs, and a panel capacitor formed among the address electrode, the scan electrode and a sustain electrode, the method comprising steps of:

(a) applying a summation of first and second voltages to one terminal of the panel capacitor through a first power source for supplying a first voltage and a first capacitor charged to a second voltage and coupling the other terminal of the panel capacitor to a third voltage; and (b) applying the summation of the first and second voltages to the other terminal of the panel capacitor through another first power source and a second capacitor charged to the second voltage and coupling the one terminal of the panel capacitor to the third voltage.

11. The method of claim 10, wherein the step (a) further comprises a step of:

charging the second capacitor with the second voltage, and wherein the step (b) further comprises a step of:

charging the first capacitor with the second voltage.

* * * * *